US006914955B2

(12) United States Patent
Klarner

(10) Patent No.: US 6,914,955 B2
(45) Date of Patent: Jul. 5, 2005

(54) HEAT EXCHANGER TUBE SUPPORT STRUCTURE

(75) Inventor: Richard G. Klarner, Georgetown (CA)

(73) Assignee: Babcock & Wilcox Canada Ltd., Cambridge (CA)

( * ) Notice: Subject to any disclaimer, the term of this patent is extended or adjusted under 35 U.S.C. 154(b) by 0 days.

(21) Appl. No.: 10/753,733

(22) Filed: Jan. 8, 2004

(65) Prior Publication Data

US 2004/0146134 A1 Jul. 29, 2004

Related U.S. Application Data

(62) Division of application No. 10/285,178, filed on Oct. 31, 2002, now Pat. No. 6,810,101.

(51) Int. Cl.[7] ..... G21C 15/00

(52) U.S. Cl. ..... 376/405; 376/402; 376/404; 376/406; 376/441; 376/442; 122/32; 122/510; 165/158; 165/159; 165/161; 165/162

(58) Field of Search ..... 376/402, 404, 376/405, 441, 442; 165/161, 162, 167, 910; 122/32, 510, 444

(56) References Cited

U.S. PATENT DOCUMENTS

| | | | | | |
|---|---|---|---|---|---|
| 3,908,756 | A | * | 9/1975 | Richardson | 165/158 |
| 4,120,350 | A | | 10/1978 | Norton | 162/162 |
| 4,191,246 | A | * | 3/1980 | Cassell | 165/134.1 |
| 4,204,305 | A | | 5/1980 | Norton | 29/157.4 |
| 4,220,199 | A | | 9/1980 | Romanos | 165/134 |
| 4,285,396 | A | * | 8/1981 | Schwoerer et al. | 165/162 |
| 4,344,480 | A | | 8/1982 | Boyer et al. | 165/162 |
| 4,359,088 | A | * | 11/1982 | Jabsen | 165/172 |
| 4,377,552 | A | * | 3/1983 | Doublet et al. | 376/405 |
| 4,576,228 | A | | 3/1986 | Glatthorn | 163/162 |
| 4,637,457 | A | | 1/1987 | Wepfer | 165/162 |
| 4,665,866 | A | * | 5/1987 | Wepfer | 122/510 |
| 4,690,206 | A | | 9/1987 | Bein | 165/81 |
| 4,709,756 | A | | 12/1987 | Wilson et al. | 165/162 |
| 4,753,773 | A | * | 6/1988 | Garabedian et al. | 376/299 |
| 4,756,770 | A | | 7/1988 | Weems et al. | 134/37 |
| 4,836,274 | A | * | 6/1989 | Firth et al. | 165/11.1 |
| 4,874,041 | A | * | 10/1989 | Crick et al. | 165/162 |
| 4,902,468 | A | | 2/1990 | Veronesi et al. | 376/327 |
| 4,933,138 | A | | 6/1990 | Mouesca et al. | 376/442 |
| 5,005,637 | A | * | 4/1991 | Gentry | 165/69 |
| 5,072,786 | A | | 12/1991 | Wachter | 165/69 |
| 5,092,280 | A | | 3/1992 | Franklin et al. | 122/379 |
| 5,178,822 | A | | 1/1993 | Buford, III et al. | 376/305 |
| 5,181,561 | A | * | 1/1993 | Ayers et al. | 165/162 |
| 5,350,011 | A | * | 9/1994 | Sylvester | 165/135 |
| 6,302,064 | B1 | * | 10/2001 | Billoue et al. | 122/491 |

FOREIGN PATENT DOCUMENTS

| | | |
|---|---|---|
| DE | 300845 | 9/1981 |
| EP | 0296018 | 12/1988 |

* cited by examiner

*Primary Examiner*—Michael J. Carone
*Assistant Examiner*—Daniel Lawson Greene, Jr.
(74) *Attorney, Agent, or Firm*—Eric Marich; Michael J. Seymour; Kathryn W. Grant

(57) ABSTRACT

A support plate for retaining tube array spacing within a heat exchanger tube and shell structure. The support plate having a plurality of individual tube receiving apertures formed therein. Each aperture has at least three inwardly protruding members and bights are formed therebetween when the tube associated therewith is lodged in place to establish secondary fluid flow through the support plate. The inwardly protruding members terminate in flat lands that restrain but do not all contact the outer surface of the respective tube. These flat lands minimize fretting wear and eliminate potential gouging of the outer wall of the tube. The plate wall forming each aperture has an hourglass configuration which, inter alia, reduces pressure drop, turbulence and local deposition of magnetite and other particulates on the support plates.

3 Claims, 4 Drawing Sheets

HEAT EXCHANGER TUBE SUPPORT STRUCTURE

CROSS REFERENCE TO RELATED APPLICATIONS

This application is divisional application of application U.S. Ser. No. 10/285,178 filed Oct. 31, 2002 now U.S. Pat. No. 6,810,101 which is hereby incorporated herein by reference. U.S. Ser. No. 10/285,178 is a continuation of U.S. Pat. No. 6,498,827 filed on Nov. 1, 1999 and issued on Dec. 24, 2002 which is hereby incorporated by reference.

FIELD AND BACKGROUND OF THE INVENTION

The invention relates generally to heat exchanger construction and more particularly to support plates for retaining tube array spacing within the heat exchanger.

DESCRIPTION OF THE PRIOR ART

The pressurized water vapor generators or heat exchangers, associated with nuclear power stations and which transfer the reactor-produced heat from the primary coolant to the secondary coolant that drives the plant turbines may be as long as 75 feet and have an outside diameter of about 12 feet. Within one of these heat exchangers, straight tubes through which the primary coolant flows may be no more than ⅝ inch in outside diameter, but have an effective length of as long as 52 feet between the tube-end mountings and the imposing faces of the tube sheets. Typically, there may be a bundle of more than 15,000 tubes in one of these heat exchangers. It is clear that there is a need to provide structural support for these tubes in the span between the tube sheet faces to ensure tube separation, adequate rigidity, and the like.

The tube support problem has led to the development of a drilled support plate structure of the type described in U.S. Pat. No. 4,120,350. This support system consists of an array of flat plates that is arranged in the heat exchanger with the planes of the individual plates lined transverse to the longitudinal axes of the tubes in the bundle. Holes or apertures are drilled and broached in each of the flat support plates to accommodate the tubes. Each aperture has at least three inwardly protruding members that restrain but do not all engage or contact the outer surface of the respective tube. Bights that are intermediate of these inwardly protruding members are formed in the individual support plate apertures when the tube associated therewith is lodged in place to establish secondary fluid flow through the plate. The inwardly protruding members terminate in arcs that define a circle of a diameter that is only slightly greater than the outside diameter of the associated tube. The broached support plates are made of SA-212 Gr.B, a carbon steel material, and may include tube free lanes with unblocked broached holes which detrimentally allow low steam quality secondary fluid flow to pass through the unblocked holes.

It has been found, after long periods of operation, that deposits consisting primarily of magnetite are formed at the tube support plates. These deposits block the bights formed between protruding members and thus cause undesirable increases in pressure drop which will in turn result in an increase in the secondary water level in the downcomer. If corrective actions are not taken, the rising water level could potentially flood the steam bleed ports and the main feed water nozzles and result in a malfunction of the steam bleeding and the main feed water systems.

Corrective actions such as power derating, chemical cleaning or water slap are costly. Moreover, the removal of deposits by chemical cleaning or water slap could damage the support plates.

Accordingly, there is a need for a tube support plate which minimizes pressure drop and deposit blockage while providing adequate structural strength.

BRIEF SUMMARY OF THE INVENTION

The problems associated with the prior art tube support plates are largely overcome by the present invention which resorts to a stronger more corrosive resistant plate material such as stainless steel and by forming hourglass shaped tube holes in the support plates which minimize pressure drop by reducing local turbulence and are less likely to cause the deposition of magnetite and other particles on the surface of the support plates.

In view of the foregoing it will be seen that one aspect of the invention is to manufacture the tube support plates out of a stronger more corrosion resistant material such as stainless steel.

Another aspect of this invention is to have the protruding members of the broached holes terminate in flat lands.

A further aspect of the present invention is to provide hourglass shaped broached holes in the tube support plates.

These and other aspects of the present invention will be more fully understood after a review of the following description of the preferred embodiment along with the accompanying drawings.

DETAILED DESCRIPTION OF THE PREFERRED EMBODIMENT

Figure 1:
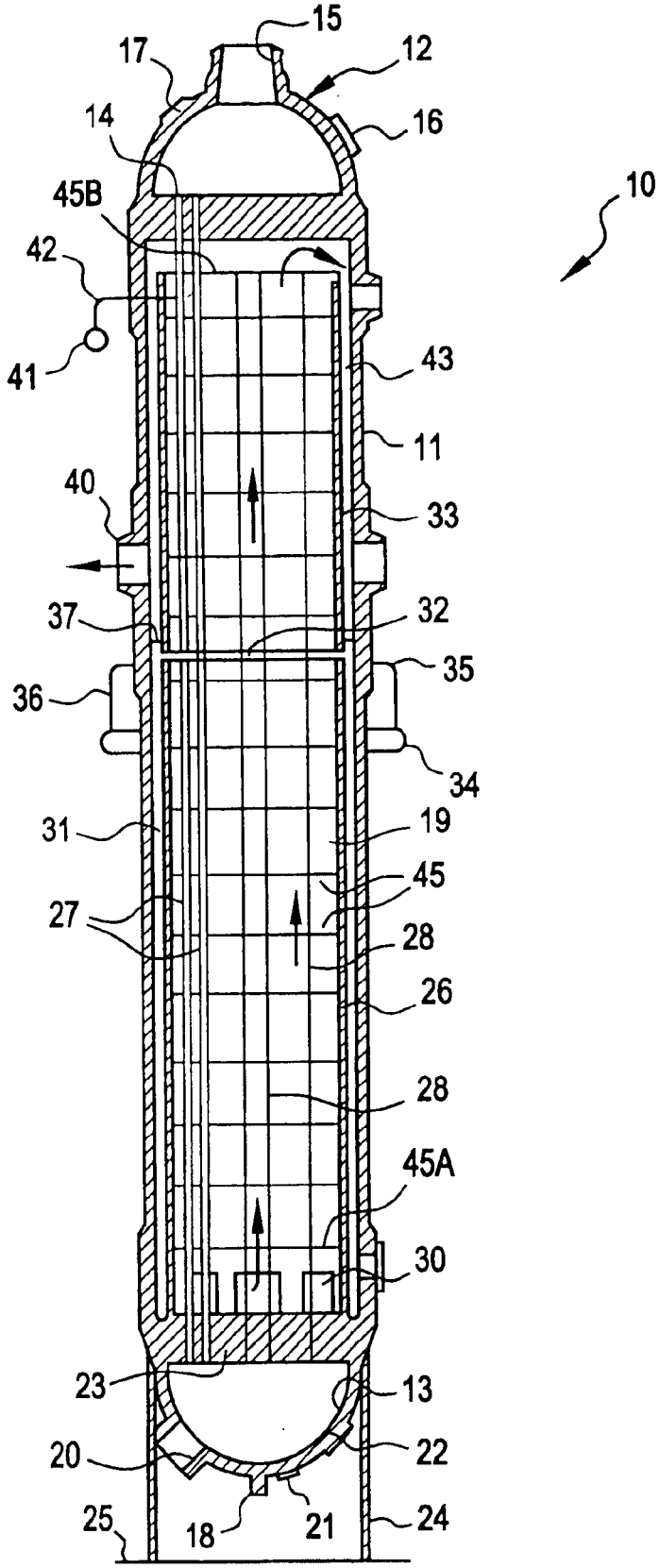
FIG. 1 is a vertical elevation view in full section of a once-through vapor generator embodying the principles of the invention.

The present invention is described in connection with a once-through steam generator for a nuclear power plant, although these principles are generally applicable to shell and tube heat exchangers in any number of diverse fields of activities. Thus, as shown in FIG. 1 for the purpose of illustration, a once-through steam generator unit 10 comprising a vertically elongated cylindrical pressure vessel or shell 11 closed at its opposite ends by an upper head member 12 and a lower head member 13.

The upper head includes an upper tube sheet 14, a primary coolant inlet 15, a manway 16 and a handhole 17. The manway 16 and the handhole 17 are used for inspection and repair during times when the vapor generator unit 10 is not in operation. The lower head 13 includes drain 18, a coolant outlet 20, a handhole 21, a manway 22 and a lower tube sheet 23.

The vapor generator 10 is supported on a conical or cylindrical skirt 24 which engages the outer surface of the lower head 13 in order to support the vapor generator unit 10 above structural flooring 25.

As hereinbefore mentioned, the overall length of a typical vapor generator unit of the sort under consideration is about 75 feet between the flooring 25 and the upper extreme end of the primary coolant inlet 15. The overall diameter of the unit 10 moreover, is in excess of 12 feet.

Within the pressure vessel 11, a lower cylindrical tube shroud wrapper or baffle 26 encloses a bundle of heat exchanger tubes 27, a portion of which is shown illustratively in FIG. 1. In a vapor generator unit of the type under consideration moreover, the number of tubes enclosed within the baffle 26 is in excess of 15,000, each of the tubes having an outside diameter of ⅝ inch. It has been found that Alloy 690 is a preferred tube material for use in vapor generators of the type described. The individual tubes in the bundle 27 each are anchored in respective holes formed in the upper and lower tube sheets 14 and 23 through belling, expanding or seal welding the tube ends within the tubesheets.

The lower baffle or wrapper 26 is aligned within the pressure vessel 11 by means of pins (not shown). The lower baffle 26 is secured by bolts (not shown) to the lower tubesheet 23 or by welding to lugs (not shown) projecting from the lower end of the pressure vessel 11. The lower edge of the baffle 26 has a group of rectangular water ports 30 or, alternatively, a single full circumferential opening (not shown) to accommodate the inlet feedwater flow to the riser chamber 19. The upper end of the baffle 26 also establishes fluid communication between the riser chamber 19 within the baffle 26 and annular downcomer space 31 that is formed between the outer surface of the lower baffle 26 and the inner surface of the cylindrical pressure vessel 11 through a gap or steam bleed port 32.

A support rod system 28 is secured at the uppermost support plate 45B, and consists of threaded segments spanning between the lower tubesheet 23 and the lowest support plate 45A and thereafter between all support plates 45 up to the uppermost support plate 45B.

A hollow taroid shaped secondary coolant feedwater inlet header 34 circumscribes the outer surface of the pressure vessel 11. The header 34 is in fluid communication with the annular downcomer space 31 through an array of radially disposed feedwater inlet nozzles 35. As shown by the direction of the FIG. 1 arrows, feedwater flows from the header 34 into the vapor generating unit 10 byway of the nozzles 35 and 36. The feedwater Is discharged from the nozzles downwardly through the annular downcomer 31 end through the water ports 30 into the riser chamber 19. Within the riser chamber 19, the secondary coolant feedwater flows upwardly within the baffle 26 in a direction that is counter to the downward flow of the primary coolant within the tubes 27. An annular plate 37, welded between the inner surface of the pressure vessel 11 and the outer surface of the bottom edge of an upper cylindrical baffle or wrapper 33 insures that feedwater entering the downcomer 31 will flow downwardly toward the water ports 30 in the direction indicated by the arrows. The secondary fluid absorbs heat from the primary fluid through the tubes in the bundle 27 and rises to steam within the chamber 19 that is defined by the baffles 26 and 33.

The upper baffle 33, also aligned with the pressure vessel 11 by means of alignment pins (not shown), is fixed in an appropriate position because it is welded to the pressure vessel 11 through the plate 37, immediately below steam outlet nozzles 40. The upper baffle 33, furthermore, enshrouds about one third of the tube bundle 27.

An auxiliary feedwater header 41 is in fluid communication with the upper portion of the tube bundle 27 through one or more nozzles 42 that penetrate the pressure vessel 11 and the upper baffle 33. This auxiliary feedwater system is used, for example, to fill the vapor generator 10 in the unlikely event that there is an interruption in the feedwater flow from the header 34. As hereinbefore mentioned, the feedwater, or secondary coolant that flows upwardly through the tube bank 27 in the direction shown by the arrows rises into steam. In the illustrative embodiment, moreover, this steam is superheated before it reaches the top edge of the upper baffle 33. This superheated steam flows in the direction shown by the arrow, over the top of the baffle 33 and downwardly through an annular outlet passageway 43 that is formed between the outer surface of the upper cylindrical baffle 33 and the inner surface of the pressure vessel 11. The steam in the passageway 43 leaves the vapor generating unit 10 through steam outlet nozzles 40 which are in communication with the passageway 43. In this foregoing manner, the secondary coolant is raised from the feed water inlet temperature through to a superheated steam temperature at the outlet nozzles 40. The annular plate 37 prevents the steam from mixing with the incoming feedwater in the downcomer 31. The primary coolant, in giving up this heat to the secondary coolant, flows from a nuclear reactor (not shown) to the primary coolant inlet 15 in the upper head 12, through individual tubes in the heat exchanger tube bundle 27, into the lower head 13 and is discharged through the outlet 20 to complete a loop back to the nuclear reactor which generates the heat from which useful work is ultimately extracted.

Figure 2:
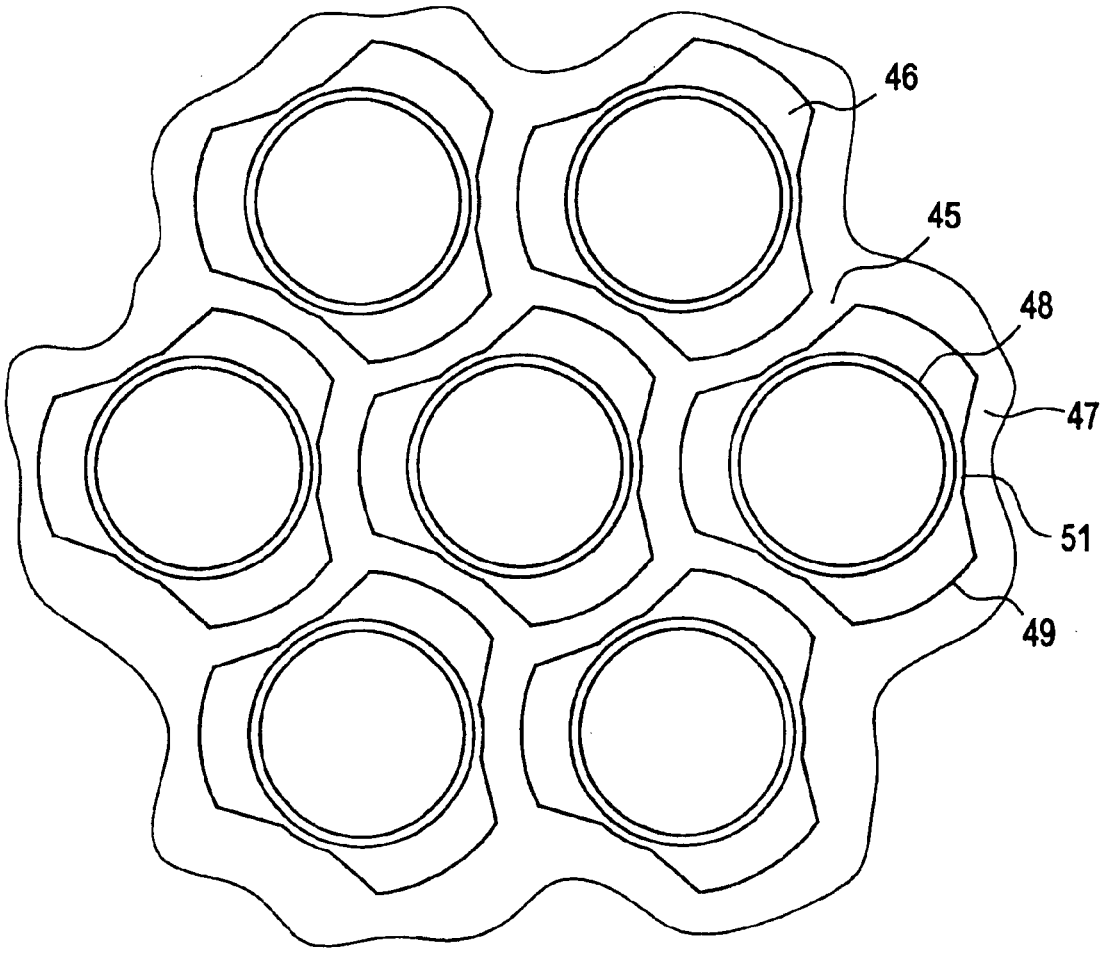
FIG. 2 PRIOR ART
FIG. 2 is a plan view of a portion of a prior art support plate.

Referring now to FIG. 2, there is shown a plan view of a portion of a prior art support plate 45 characterized by holes or apertures 46, each of which has at least three inwardly protruding members 47 that restrain but do not all engage or contact the outer surface of the tube 48 extending through the hole 46. Bights 49 that are intermediate of these inwardly protruding members 47 are formed in the individual support plate holes 46 when the associated tube 48 is lodged in place to establish fluid passage through the plate 45. The inwardly protruding members 47 terminate in arcs or arcuate lands 51 that define a circle of a diameter that is only slightly greater than the outside diameter of the associated tube 48.

Figure 3:
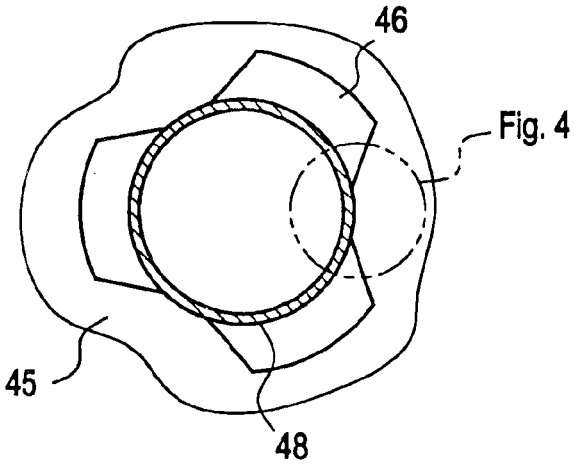
FIG. 3 PRIOR ART
FIG. 3 is a plan view of one of the broached holes in the prior art support plate shown in FIG. 2 with a tube inserted therethrough.
Figure 4:
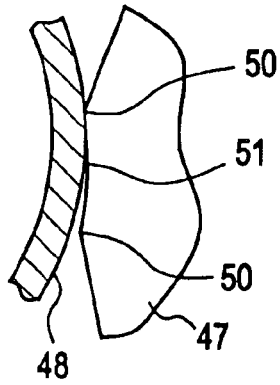
FIG. 4 PRIOR ART
FIG. 4 is a detail view of a portion of the tube abutting one of the protruding members of the prior art broached hole shown in FIG. 3.

Turning now to prior art FIG. 3, there is shown a plan view of one of the broached holes 46 and a portion of the surrounding support plate 45 of FIG. 2 with a tube 48 inserted through the broached hole 46. A detail of FIG. 3 is shown at FIG. 4 which depicts a problem encountered with this prior art broached hole 46 whereby the sharp edges 50 formed along the vertical sides of the arcuate land 51 of the inwardly protruding member 47 can potentially gouge the outer wall of tube 48 thereby resulting in a faster increase in the depth rate at which through-wall tube wear occurs for a given volume loss. This prior art support plate 45 also allows for a small annular space between the arcuate land 51 and the outer wall of tube 48 and, due to the associated flow restrictions, results in rapidly accumulating detrimental deposits for at least some of the support plates 52.

Figure 5:
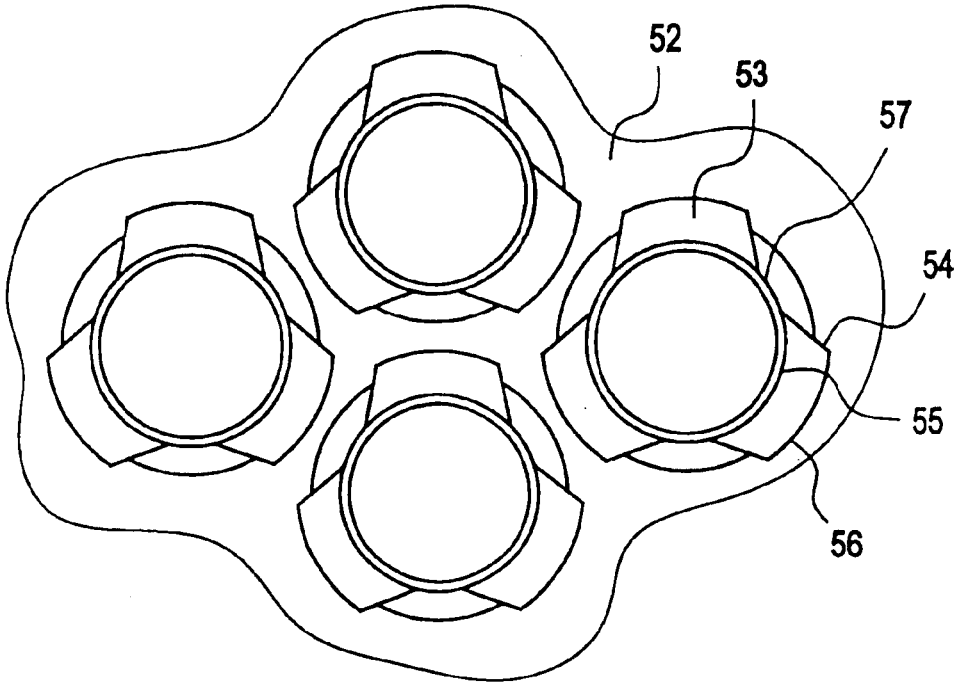
FIG. 5 is a plan view of a portion of a support plate and tube assembly that embodies principles of the invention for use with a heat exchanger of the type shown in FIG. 1.

Referring now to FIG. 5, there is shown a plan view of a portion of support plate 52 characterized by holes or apertures 53, each of which has at least three inwardly protruding members 54 that restrain but do not all engage or contact the outer surface of the tube 55 extending through the hole 53. Bights 56 that are intermediate of these inwardly protruding members 54 are formed in the individual support plate holes 53 when the associated tube 55 is lodged in place to establish fluid passage through the plate 52. In accordance with the present invention, the inwardly protruding members 54 terminate in flat lands 57.

Figure 6:
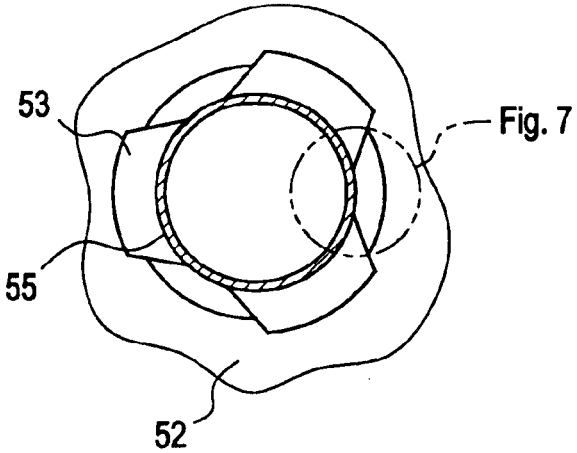
FIG. 6 is a plan view of one of the broached holes in the support plate shown in FIG. 5 with a tube inserted therethrough.
Figure 7:
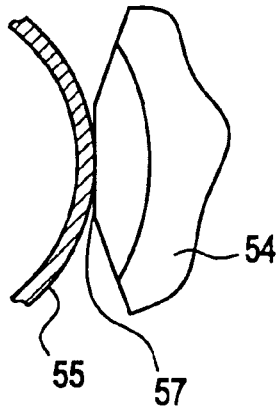
FIG. 7 is a detail view of a portion of the tube abutting one of the protruding members of the broached hole shown in FIG. 6.

Turning now to FIG. 6, there is shown a plan view of one of the broached holes 53 of FIG. 5 and a portion of the surrounding support plate 52. A tube 55 extends through the broached hole 53. A detail of FIG. 6 is shown at FIG. 7 where the flat land 57 of the inwardly protruding member 54 provides sufficient tube contact length to lower contact stress thereby minimizing fretting-wear of the tube 55. The flat land configuration has its area extending laterally beyond the part which makes contact with the tube 55, and thus eliminates the potential gouging of the outer wall of tube 55 thus decreasing the depth rate at which through-wall wear occurs for a given volume loss. Moreover, the space between the flat land 57 and the outer wall of tube 55 is increased to reduce deposition accumulation.

Figure 8:
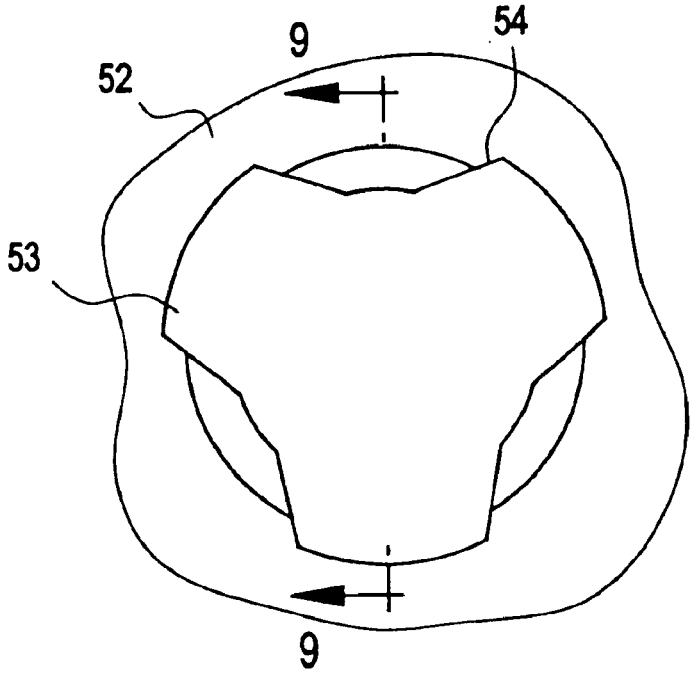
FIG. 8 is a plan view of one of the broached holes in the support plate shown in FIG. 5 with the tube removed.
Figure 9:
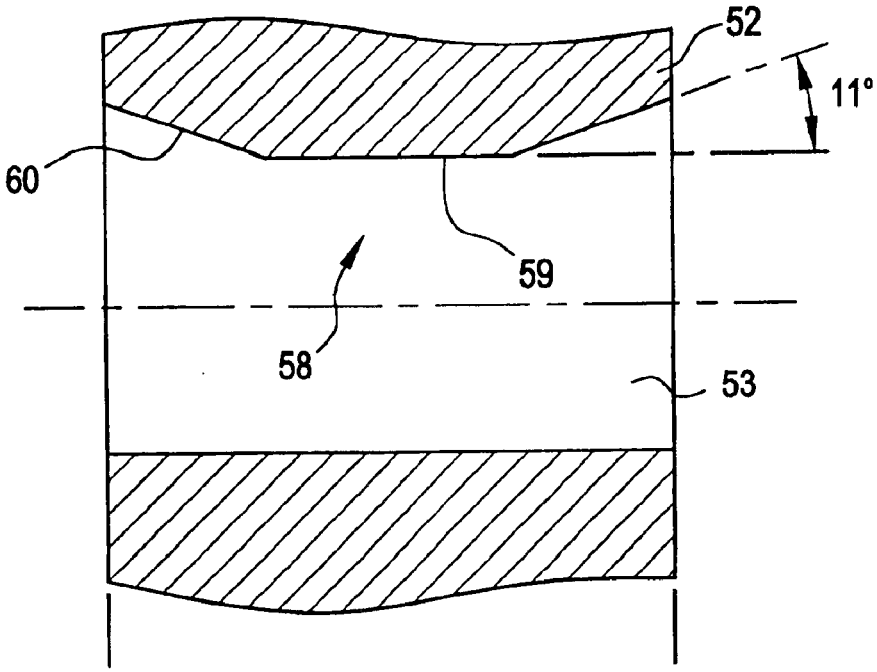
FIG. 9 is a cross-sectional view taken along lines A—A of FIG. 8 showing the hourglass feature of the present invention.

Referring to FIG. 8, there is shown a plan view of one of the broached holes 53 of FIG. 5 and a portion of the surrounding support plate 52. As shown in FIG. 8 and in FIG. 9 which is a cross-sectional view taken along line 9—9 of FIG. 8, the inner wall 58 forming the protruding member 54 in the support plate 52 has an hourglass configuration comprised of a tube contact section 59 with beveled end sections 60. In a tube support plate of the type under consideration, the thickness of the broached plate is 1.5 inches, the length of the tube contact section 59 is 0.75 inches, and the chamfer angle of the beveled end section 60 is 11 degrees.

The beveled end sections 60 of the broached holes 53 improve the local fluid flow patterns and reduce the deposition of magnetite and other particles on the support plate 52 due to a decrease in hydraulic shock losses. Computational fluid dynamic modelling of the flow paths through an hourglassed broached hole 53 and experimental testing have confirmed that the gradual contraction and expansion of the fluid flow therethrough effectively reduces pressure drop which contributes to the greater margin for system pressure drop increases. Furthermore, as a result of a reduction in the hydraulic loss coefficient, the hourglassed configured broached holes 53 contribute to greater margins for water level problems such as water level instability and high water levels resulting from high pressure drops. The hourglass configuration reduces fluid turbulence in the area of contact between tube 55 and the protruding member 54 of support plate 52 thereby reducing local deposition of magnetite and other particles on the support plate 52. The hourglass configuration also allows for greater rotational motions between tubes 55 and the protruding members 54 before experiencing binding due to a moment couple from opposing forces at the top and bottom edges of the tube support plate 52.

According to the present invention, the tube support plate 52 is made of stainless SA-240 410S material with a specified high yield of 50 ksi or above and ultimate tensile strength (UTS) of 80 ksi or above.

The following chart shows the superiority of the SA-240 410S stainless steel material of the present invention when compared to the SA-212 Gr.B carbon steel used to make the prior art tube support plates 47.

| Material Specification | Chemical | Yield (ksi) | UTS (ksi) |
|---|---|---|---|
| SA-212 GrB | C—Si | 38 ksi (min) | 70 ksi (min) |
| SA-240 410S | 13 Cr | 50 ksi (min) | 80 ksi (min) |

From the foregoing it is thus seen that the tube support plates 52 made with SA-240 410S stainless material provide (1) improved corrosion resitance; (2) higher strength; and (3) improved compatibility to minimize fretting wear with the tubes 55 which are made of Alloy 690 material.

While a specific embodiment of the invention has been shown and described in detail to illustrate the application of the principles of the invention, it will be understood that the invention may be embodied otherwise without departing from such principles.

What is claimed is:

1. A method for reducing deposits in a heat exchanger tube and shell structure, comprising:

providing a generally flat support plate having a plurality of individual tube receiving apertures formed therein;

providing at least three members integral with the plate defining each of the apertures, the integral members protruding inwardly toward the center of the respective aperture and forming bights between at least adjacent pairs of the members in order to provide a predetermined flow area when the tube that is individual to the respective aperture is lodged in place, the flow area having an inlet and an outlet, the members having beveled end sections at one of the inlet and the outlet, the inwardmost end of each of the integral members forming a flat land area, said protruding integral member flat land area restraining but not all contacting the outer surface of the individual tube that is to be received within the respective aperture, wherein only part of the flat land area is contacting the outer surface of said tube.

2. The method of claim 1, wherein the members have beveled end sections at the inlet.

3. The method of claim 1, wherein the members have beveled end sections at the outlet.

* * * * *